US006715266B2

(12) United States Patent
Browning

(10) Patent No.: US 6,715,266 B2
(45) Date of Patent: Apr. 6, 2004

(54) BOTTLE UNPACK/REPACK APPARATUS AND METHODS

(75) Inventor: David M. Browning, Portland, OR (US)

(73) Assignee: Altman Browning and Company, Portland, OR (US)

( * ) Notice: Subject to any disclaimer, the term of this patent is extended or adjusted under 35 U.S.C. 154(b) by 106 days.

(21) Appl. No.: 10/006,164

(22) Filed: Dec. 4, 2001

(65) Prior Publication Data

US 2003/0101694 A1 Jun. 5, 2003

(51) Int. Cl.[7] ..... B67B 7/00
(52) U.S. Cl. ..... 53/492; 53/381.2
(58) Field of Search ..... 53/492, 381.2; 83/35, 471; 414/403, 412

(56) References Cited

U.S. PATENT DOCUMENTS 3,818,785 A * 6/1974 Wakabayashi ..... 82/101
4,621,970 A * 11/1986 Wurfel et al. ..... 414/412
5,033,929 A * 7/1991 Marti ..... 414/403
5,201,788 A * 4/1993 Le Naour ..... 53/468
5,442,895 A * 8/1995 Linson ..... 53/381.2
5,456,060 A * 10/1995 Tipp ..... 53/492
5,475,967 A * 12/1995 Levi ..... 53/492
5,649,801 A * 7/1997 White ..... 414/412
5,715,659 A * 2/1998 Norton ..... 53/492
5,826,409 A * 10/1998 Slepicka et al. ..... 53/492
5,857,391 A * 1/1999 Renstrom ..... 82/101
6,298,638 B1 * 10/2001 Bettle ..... 53/452
6,481,180 B1 * 11/2002 Takahashi et al. ..... 53/237
6,554,465 B2 * 4/2003 Cruso ..... 414/412

* cited by examiner

*Primary Examiner*—Rinaldi I. Rada
*Assistant Examiner*—John Paradiso
(74) *Attorney, Agent, or Firm*—Ganz Law PC; Paul J. Fordenbacher, Esq.

(57) ABSTRACT

Apparatus and methods are provided to enable the removal of tablet and capsule medication from bottles. The apparatus includes a bottle opener assembly that enables the removal of the medication from the base of the bottle. Removal of the medication from the base of the bottle bypasses the need for removal of the bottle cap, tamper-resistant seals, and any filler material. The present invention further includes an automated unpack/repack system for packing the medication in bulk and individual containers.

42 Claims, 9 Drawing Sheets

100

100
182
190
198
102

100
160
180
182
190
184
199
195
198
140
120

BOTTLE UNPACK/REPACK APPARATUS AND METHODS

FIELD OF THE INVENTION

This invention pertains to apparatus and methods to enable the unpacking of tablet and capsule medications from bottles for subsequent repackaging.

BACKGROUND OF INVENTION

Medications, either in tablet or capsule form, are commonly bottled by the pharmaceutical producer in one or more standardized quantities suitable for dispensing to the public. Medications, though, are commonly prescribed by a physician to the patient in quantities not conforming to the producer's standardized quantities. Therefore, prescriptions deviating from the standardized quantities require the medications to be unpacked from their original containers and repackaged in the desired quantities.

With the advent of automated prescription dispensing equipment, such as those used in hospitals and mail-order pharmacies, there is a need to supply the medications in bulk quantities. Many pharmaceutical producers do not supply the medications in the bulk quantities required for these systems. Again, the tablet or capsule medications require unpacking and repackaging in order to supply these users.

Pharmaceutical producers commonly supply the tablet and capsule medications in polyethylene bottles, or bottles composed of other plastics. Once the medicines are deposited within the bottles, it is common that any remaining void within the bottle is filled with cotton filler and the like. The filler prevents the tablets or capsules from shifting during shipping and handling in an effort to prevent damage to the contents. The bottles are subsequently sealed with various tamper-resistant inner and outer seals as well as capped with child and/or tamper-resistant caps.

The current methods of unpacking and repackaging tablet and capsule medications are labor intensive and inefficient. The child and/or tamper-resistant cap, as well as any tamper resistant seals require removal to access the medications. Subsequently, the cotton filler requires removal; an operation not amenable to automated equipment.

There is a need for apparatus and methods to replace the labor intensive and inefficient process of unpacking and repackaging bottled tablet and capsule medications. In order to be economical and efficient, the system must operate at high volume throughput with minimal human intervention.

SUMMARY OF INVENTION

The present invention includes apparatus and methods for the efficient and economical removal of tablet and capsule medications from polyethylene and other plastic bottles. The inventive apparatus includes a bottle opener assembly that enables the removal of the medications from the base of the bottle. Removal of the medication from the base of the bottle bypasses the need for removal of the bottle cap, tamper-resistant seals, and any filler material.

The present invention further includes an automated unpack/repack system for packing the medications in bulk and individual containers.

DESCRIPTION

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Figures 1A, 1B, 1C:
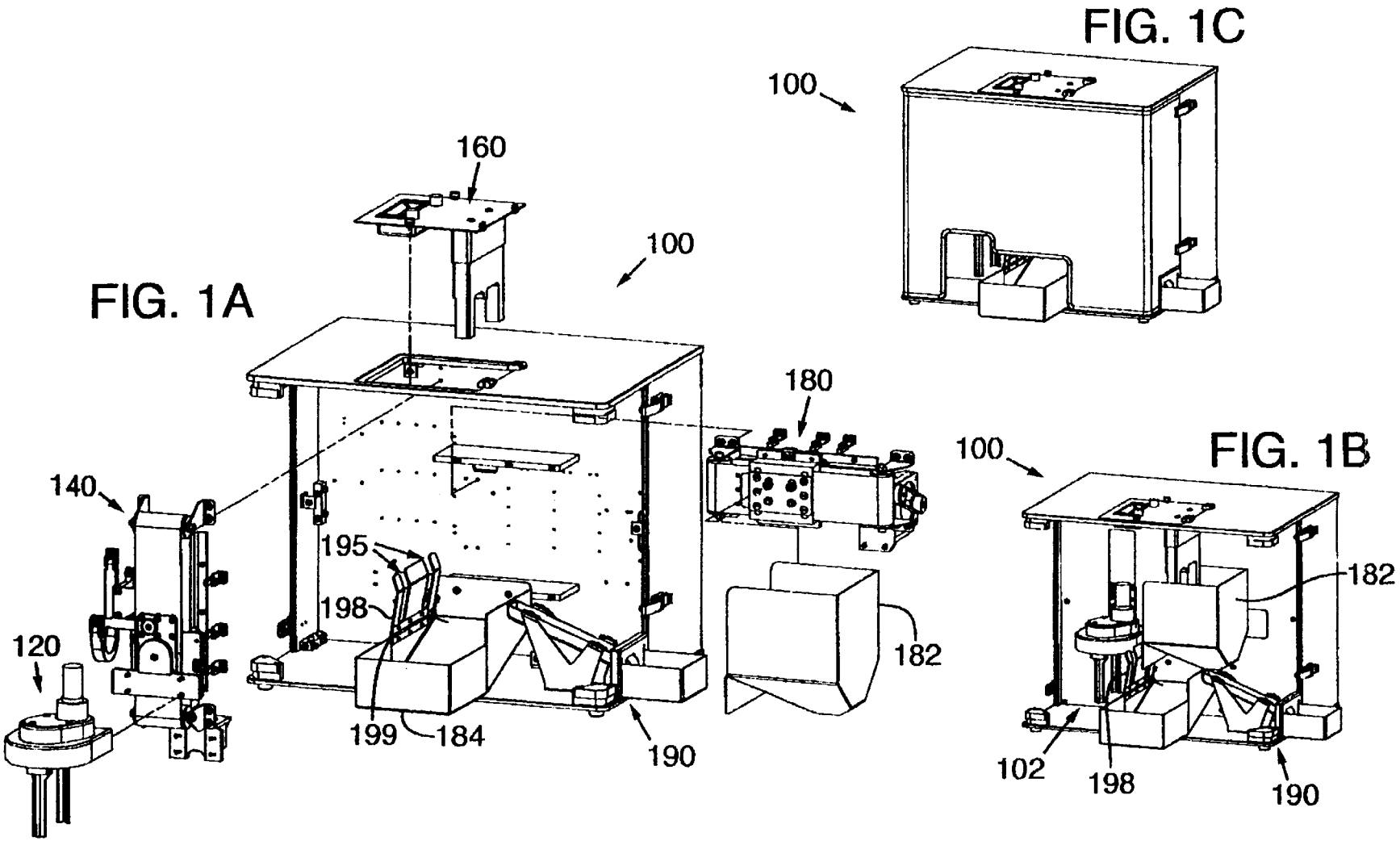
FIGS. 1A, 1B and 1C are exploded, partially assembled, and assembled perspective views, respectively, of a bottle opener assembly in accordance with the present invention.
Figure 5:
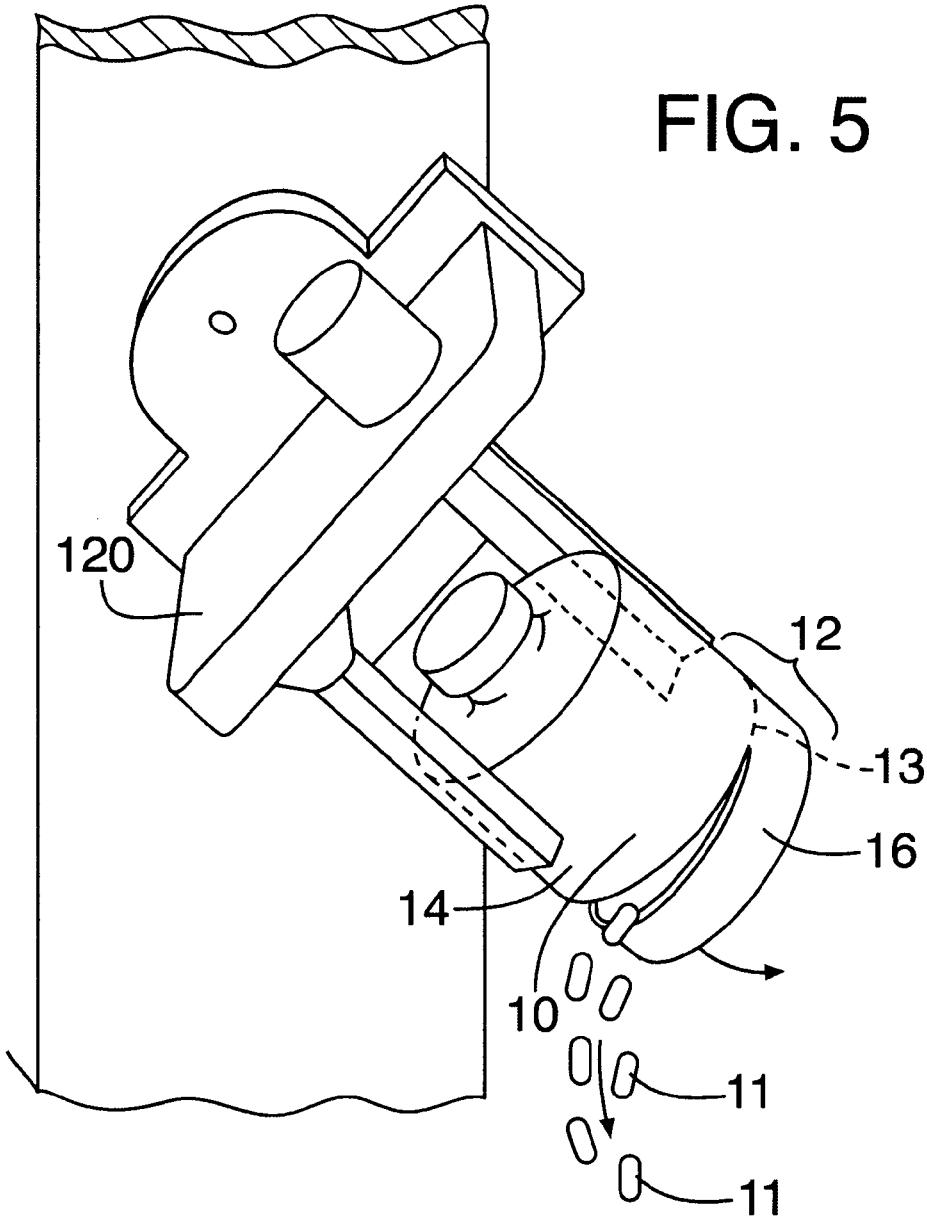

FIGS. 1A, 1B and 1C are exploded, partially assembled, and assembled perspective views, respectively, of a bottle opener assembly 100. The bottle opener assembly 100 provides the ability to access the contents 11 of a bottle 10, as shown in FIG. 5 through an opening in the lower portion 12 of the bottle 10 adjacent the base 16 of the bottle 10. The bottle opener assembly 100 may be a stand-alone apparatus or a component of a bottle unpack/repack system that opens the bottles 10 and directs the bottle's contents 11 to subsequent components of the system to repackage the contents 11 into a container, such as, but not limited to, a bulk container 262 and new bottles 20.

Figure 2:
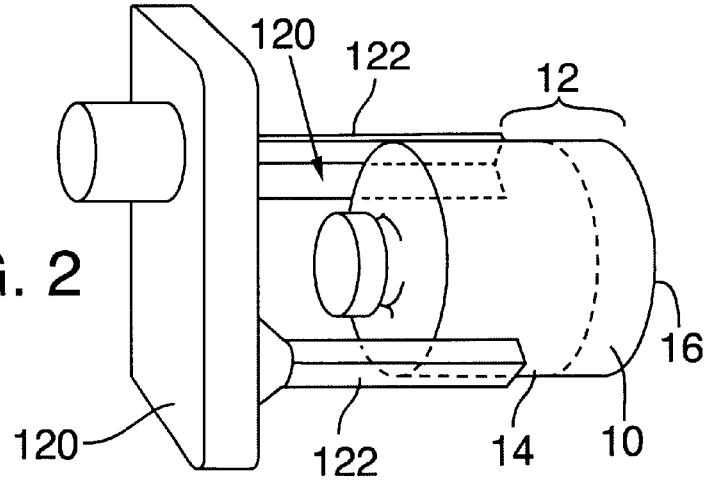
FIGS. 2–5 are perspective views of the gripper assembly in accordance with the present invention.

One embodiment of the bottle opener assembly 100 in accordance with the present invention comprises a gripper assembly 120, a translate/rotate assembly 140, a bottle slicer assembly 160, a discharge chute traverse assembly 180, and a second discharge chute 190. The gripper assembly 120 is adapted to firmly grip a bottle 10 standing in a vertical position as shown in FIG. 2. The gripper assembly 120 provides that the lower portion 12 of the bottle 10 remains unobstructed. The gripper assembly 120 is coupled to the translate/rotate assembly 140. The translate/rotate assembly 140 is adapted to lift the gripper assembly 120 and attached bottle 10 away from a bottle 10 pick-up location 102, as shown in FIG. 1B. In addition, the translate/rotate assembly 140 is adapted to rotate the gripper assembly 120 to position the bottle 10 in a horizontal position.

Figure 3:
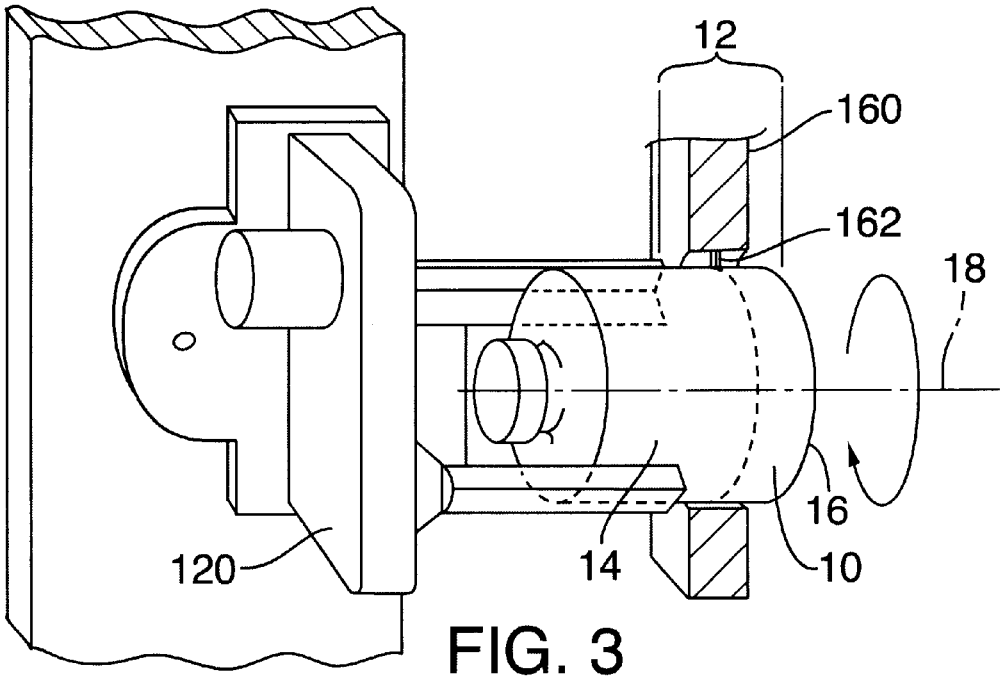
Figure 4:
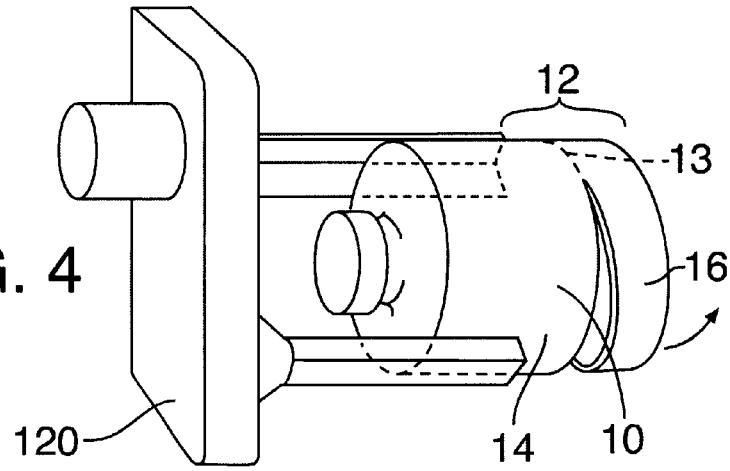

Adjacent the translate/rotate assembly 140 is the bottle slicer assembly 160. The translate/rotate assembly 140 positions the bottle 10 such that the bottle sidewall 14 proximal the base 16 of the bottle 10 makes contact with a cutting blade 162 of the bottle slicer assembly 160 as shown in FIG. 3. This contact provides for the cutting blade 162 of the bottle slicer assembly 160 to pierce the sidewall 14 of the bottle 10. The gripper assembly 120 is adapted to spin the bottle 10 about an axis 18 of the bottle 10 while held in a horizontal position. The rotation enables the cutting blade 162 to slice the bottle sidewall 14 circumferentially about the base 16 of the bottle 10. The bottle sidewall 14 is sliced such that the base 16 of the bottle 10 remains attached to the bottle 10 by a tab 13 of material as shown in FIG. 4.

The base 16 of the bottle 10 is subsequently pivoted away from the bottle sidewall 14 about the tab 13 connecting the base 16 of the bottle 10 with the bottle sidewall 14. The bottle 10 is rotated in a downward direction as shown in FIG. 5 such as to cause the contents 11 of the bottle 10 to be discharged into the first discharge chute 182 of the discharge chute traverse assembly 180, as shown in FIG. 1B. The first discharge chute 182 directs the contents 11 of the bottle 10 to a secondary discharge chute 190 such that the contents 11 are directed out of the bottle opener assembly 100. The discharge chute traverse assembly 180 is adapted to translate in a horizontal direction away from the bottle 10 to expose the bottle discharge chute 184 below. The gripper assembly 120 releases the empty bottle 10 into the bottle discharge chute 184 where the empty bottle 10 is further processed or discarded. The gripper assembly 120 returns to the bottle pick-up location 102 to start the process again.

Figure 6:
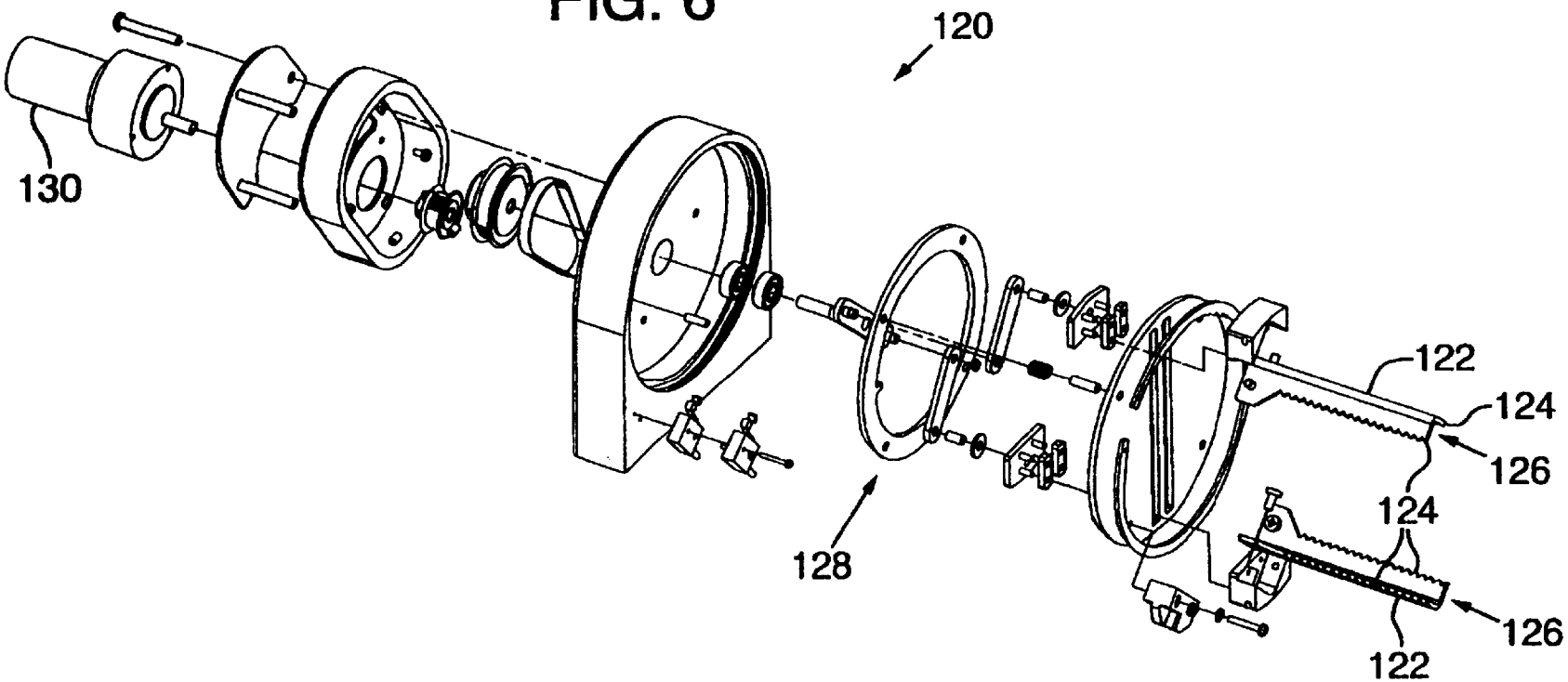
FIG. 6 is an exploded perspective view of an embodiment of the gripper assembly in accordance with the present invention.

FIG. 6 is an exploded perspective view of an embodiment of the gripper assembly 120 in accordance with the present invention. The gripper assembly 120 is adapted to firmly grip bottles of various shapes and sizes standing in a vertical position. The gripper assembly 120 comprises at least two elongated members or gripping tangs 122. The gripping tangs 122 are held in parallel relationship with each other and are adapted to translate together and away from each other. The tangs 122 are positioned a distance apart from each other such that the tangs 122 can be brought down from above the bottle 10 to be positioned adjacent to and on opposite sides of the bottle sidewall 14. Each gripping tang is shaped to enable the tangs 122 to firmly grip bottles of various shapes and sizes, including round, oval, and square shapes. In the embodiment of FIG. 6, each of the two tangs 122 has a vee-shaped cross-section with serrated edges 124.

The tangs 122 are assembled in a camming assembly 128 employing a motor 130 to move the tangs 122 toward and away from each other in a linear and parallel fashion. The trough 126 of each tang 122 is positioned facing the bottle sidewall 14 as shown in FIG. 2.

In an embodiment of the method of the invention as shown in FIGS. 2–5, the gripper assembly 120 is positioned above a standing bottle 10. The gripper assembly 120 is lowered onto the bottle 10 such the tangs 122 are positioned on either side of the bottle sidewall 14, while positioned a distance from the base 16 of the bottle 10. The motor 130 is used to drive the camming assembly 128 to bring the tangs 122 together and in contact with the bottle sidewall 14. The gripper assembly 120 provides a secure grip to the bottle 10 sufficient to hold the bottle 10 as it is lifted into position and rotated against a cutting blade 162, as shown in FIG. 3. The distance of the gripping tangs 122 above the base 16 of the bottle 10, defining the lower portion 12, provides that the lower portion 12 of the bottle sidewall 14 remains uncovered around the circumference to allow access by the cutting blade 162.

Figure 7B:
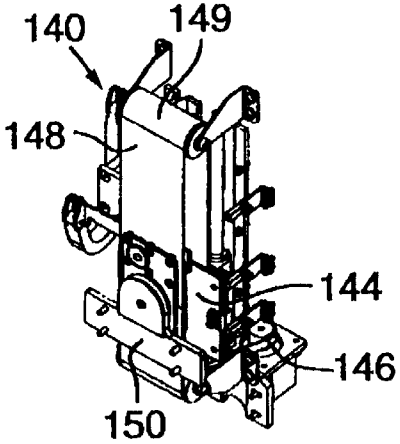
FIGS. 7A and 7B are exploded and assembled perspective views of the translate/rotate assembly in accordance with an embodiment of the invention.
Figure 7A:
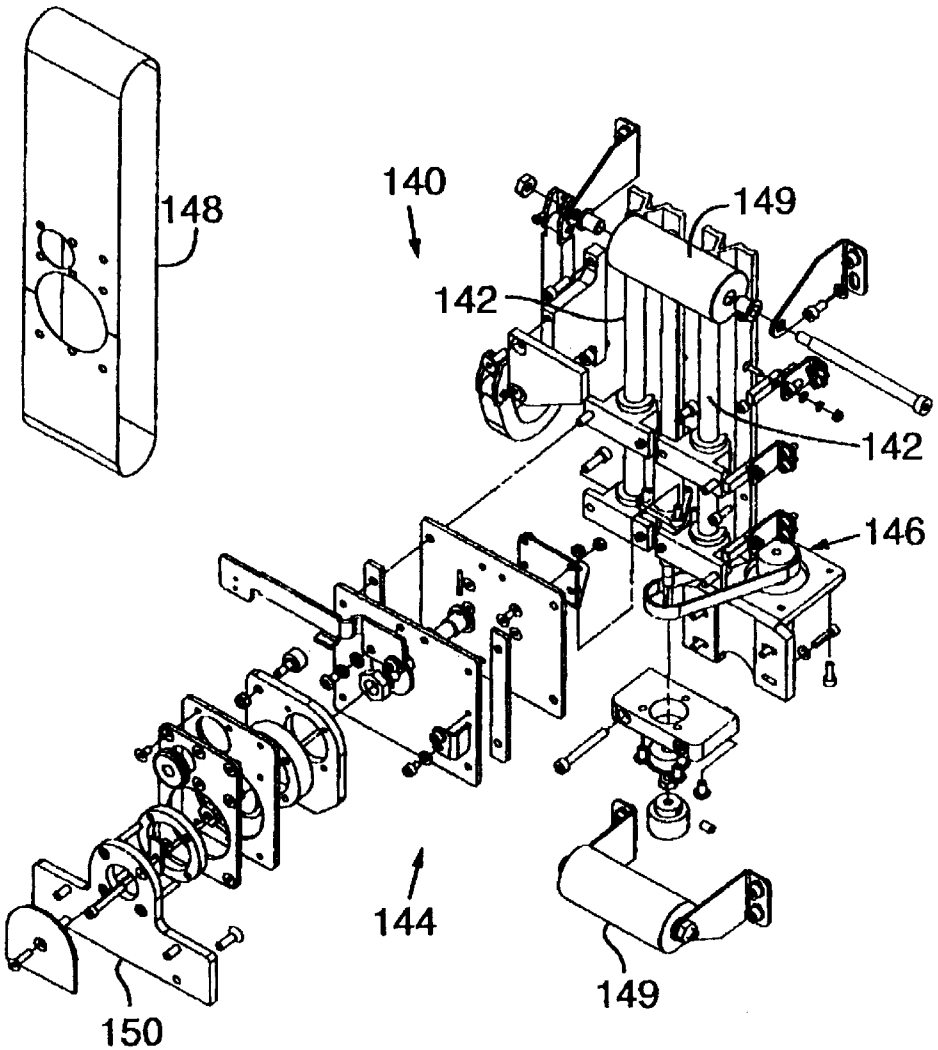

FIGS. 7A and 7B are exploded and assembled perspective views of the translate/rotate assembly 140 in accordance with an embodiment of the invention. The translate/rotate assembly 140 comprises two parallel rods 142 upon which a carriage assembly 144 is attached. A belt-driven drive assembly 146 translates the carriage assembly 144 vertically along the rods 142. A dust belt 148 between two rollers 149 is provided. The belt 148 is attached to one side of the carriage assembly 144, such that as the carriage assembly 144 is translated along the rods 142, the belt 148 moves with the carriage assembly. The belt 148 provides protection to the rods 142 and other components from dust and the like.

The carriage assembly 144 comprises an anchor 150 for coupling the gripper assembly 120 to the carriage assembly 144. The gripper assembly 120 is raised and lowered as the carriage assembly 144 is raised or lowered. The anchor 150 is adapted to rotate, such that the attached gripper assembly 120 and bottle 10 may be rotated from a vertical position to a horizontal position.

Figures 8A, 8B:
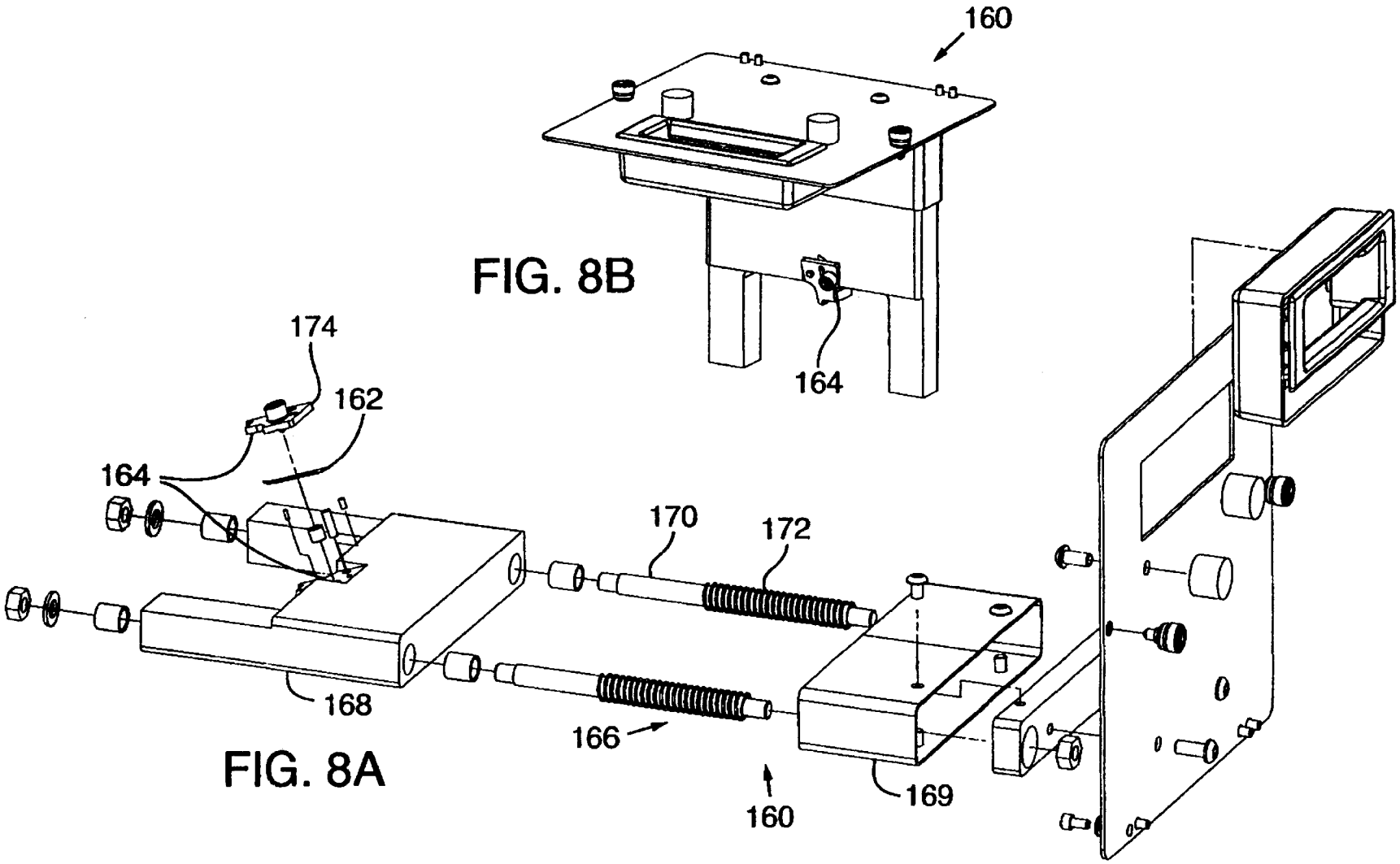
FIGS. 8A and 8B are exploded and assembled perspective views of a slicer assembly in accordance with an embodiment of the present invention.

FIGS. 8A and 8B are exploded and assembled perspective views of a slicer assembly 160 in accordance with an embodiment of the present invention. The slicer assembly 160 comprises a blade 162, a blade guide 164, and a nesting frame assembly 166. The nesting frame assembly 166 comprises first portion 168 and a second portion 169 adapted to telescopically nest one within the other. The first portion 168 and the second portion 169 are coupled together with a pair of spring-biased rods 170. The rods 170 guide the first portion 168 and the second portion 169 in linear translation with respect to each other. The springs 172 provide a bias force to hold the first portion 168 and the second portion 169 apart.

A blade guide 164 is provided either as a component of the first portion 168 of the nesting frame assembly 166 and/or as a component of a blade-coupling element 174. The blade guide 164 is adapted to allow the blade 162 to penetrate the bottle sidewall 14 but to prevent the blade 162 from extending into the bottle 10 a distance that could damage the bottle's contents 11. The blade 162 is coupled to the first portion 168 by the a blade-coupling element 174. The blade-coupling element 174 provides for easy and quick blade 162 replacement.

In accordance with an embodiment of the method of the present invention, during a piercing and slicing operation, the bottle 10 is placed in contact with the blade 162 with the blade 162 piercing the bottle sidewall 14 and the sidewall 14 abutting the blade guide 164. The bottle 10 is urged against the blade guide 164 with sufficient force to move the first portion 168 and partially compress the springs 172. The spring bias force on the blade guide 164 against the bottle sidewall 14 is sufficient to enable full contact between the blade 162 and the bottle sidewall 14 while the bottle 10 is rotated against the blade 162. The spring bias force provides for full blade 162 contact with the bottle sidewall 14 as the blade guide 164 follows the contour of bottle 10. In this manor, bottles 10 of various contours, such as oval and square, are accommodated.

In one embodiment in accordance with the invention, the blade 162 is coupled to the first portion 168 of the nesting assembly 166 at an angle to the bottle sidewall 14 to facilitate the piercing and slicing of the bottle sidewall 14.

Figure 9B:
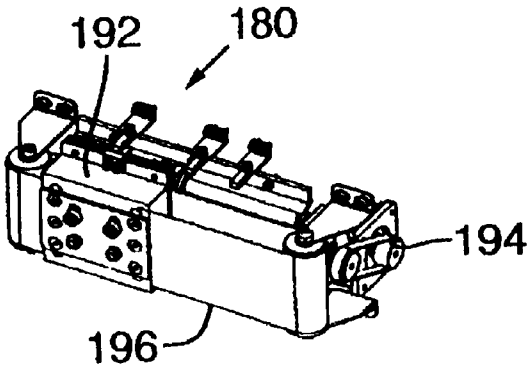
FIGS. 9A and 9B are exploded and assembled perspective views of a discharge chute traverse assembly in accordance with an embodiment of the invention.
Figure 9A:
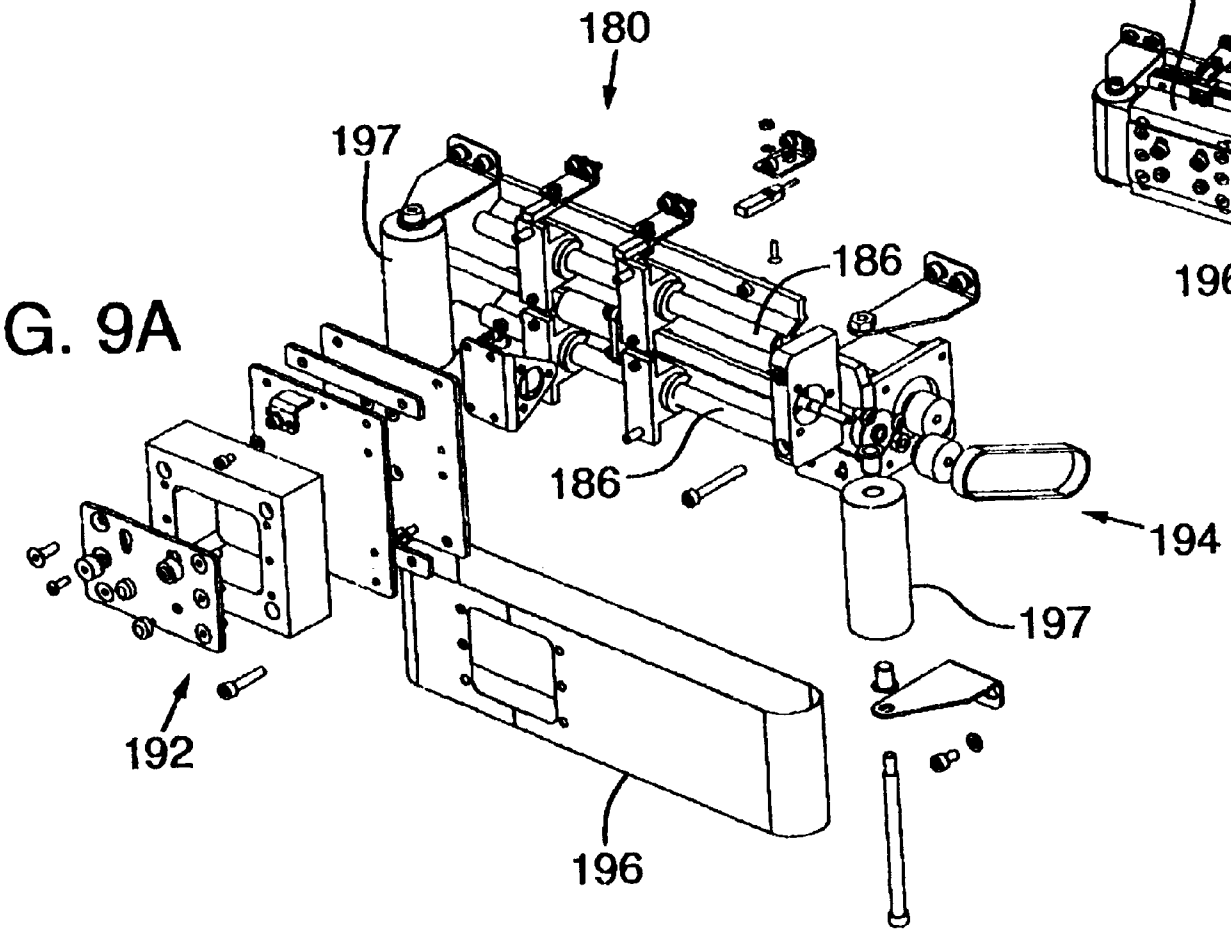

FIGS. 9A and 9B are exploded and assembled perspective views of a discharge chute traverse assembly 180 in accordance with an embodiment of the invention. The discharge chute traverse assembly 180 comprises two parallel rods 186 upon which a discharge chute carriage assembly 192 is attached. A first discharge chute 182 is coupled to the discharge chute carriage assembly 192 as shown in FIG. 1B. A belt-driven drive assembly 194 translates the first discharge chute 182 horizontally along the rods 186. A belt 196 stretched between two rollers 197 is provided between the parallel rods 186 and the first discharge chute 182. The belt 196 is attached to one side of the discharge chute carriage assembly 192, such that as the discharge chute carriage assembly 192 is translated horizontally along the rods 186, the belt 196 moves with the discharge chute carriage assembly 192. The belt 196 provides protection to the rods 186 and other components from dust and the like.

The discharge chute traverse assembly 180 is adapted to position a first discharge chute 182 below the bottle 10 when the bottle 10 is positioned against the bottle slicer assembly 160. After the bottle slicing operation, the contents 11 of the bottle 10 is allowed to drop into the first discharge chute 182, which directs the contents 11 to a second discharge chute 190 and out of the bottle slicer assembly 160 as shown in FIG. 1B. The gripper assembly 120 is adapted to rotate the bottle 10 in a downward direction to facilitate the discharge of the contents 11 of the bottle 10 into the first discharge chute 182. When the bottle 10 is empty, the discharge chute traverse assembly 180 is adapted to translate the first discharge chute 182 horizontally out from under the bottle 10 to expose the bottle 10 to the bottle discharge chute 184 below. The gripper assembly 120 subsequently releases the bottle 10 into the bottle discharge chute 184 for processing or disposal.

In one embodiment in accordance with the present invention, the bottle discharge chute 184 further comprises a bottle guide 198, as shown in FIG. 1A. The bottle guide 198 is coupled to the bottle discharge chute 184 with a hinge 199. The bottle guide 198 is adapted to flex out of the way in one direction when contacted by the bottle 10 as the gripper assembly 120 positions the bottle 10 from a vertical position to the horizontal position, and to subsequently return back into position when contact is released. The bottle guide 198 keeps the empty bottle 10 directed into the bottle discharge chute 184 when released by the gripper assembly 120. The bottle guide 198 further comprises two cutouts 195 to allow the gripper tangs 122 to pass through the bottle guide 198 when returning to the bottle pickup position 102.

Figure 10B:
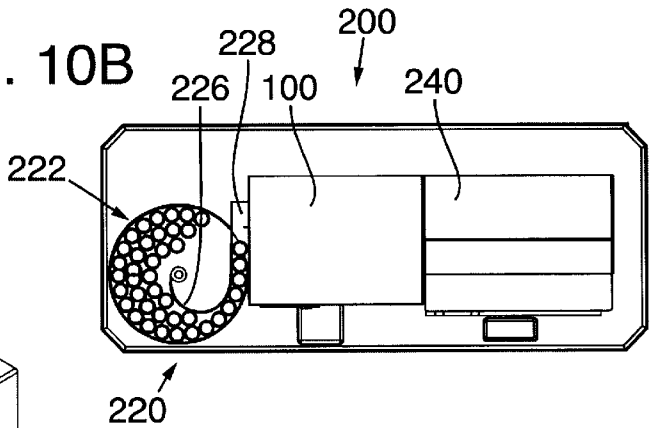
FIGS. 10A, 10B and 10C are perspective, top and side views of an embodiment of a bottle unpack/repack system in accordance with an embodiment of the invention.
Figure 10C:
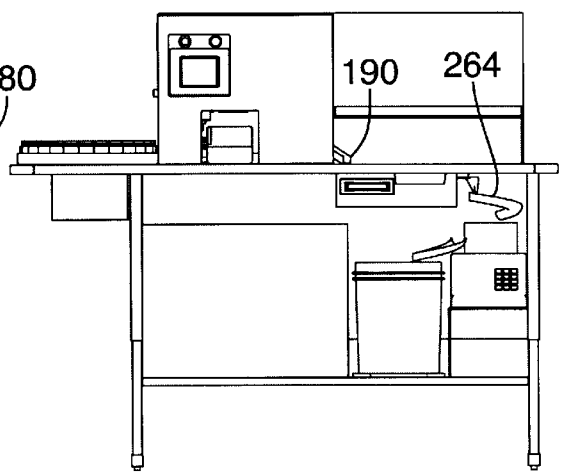
Figure 10A:
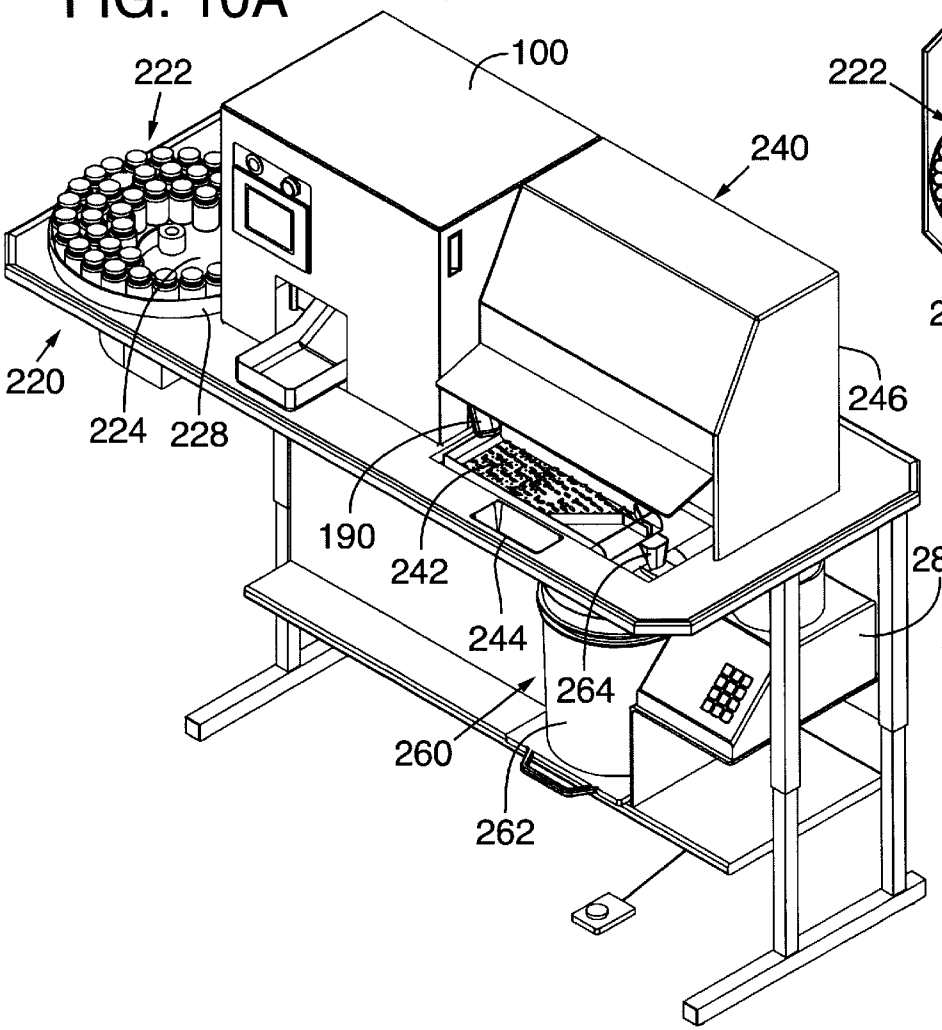

FIGS. 10A, 10B and 10C are perspective, top and side views of an embodiment of a bottle unpack/repack system 200 in accordance with an embodiment of the present invention. The bottle unpack/repack system 200 comprises a bottle feed assembly 220, the bottle opener assembly 100 as previously presented, an inspection tray conveyor assembly 240, a bulk container assembly 260, and a control assembly 280. The bottle feed assembly 220 is adapted to convey a plurality of bottles 10 in an upright position in single file fashion to the gripper assembly 120. The bottle feed assembly 220 may be of any type suitable for the intended purpose and are commonly known in the art. One embodiment of a bottle feed assembly 220 comprises a hopper 222, a turntable 224, and a bottle feed discharge chute 228. The hopper 222 commonly has spiral-shaped walls 226 with the turntable 224 as the floor. The spiral-shaped walls 226 are of a height that can contain the bottles 10 while the turntable 224 rotates beneath the bottles 10. The rotation of the turntable 224 feeds the bottles 10 into the narrow end of the spiral-shaped walls 226 such that the bottles 10 are forced into a single-file configuration. The bottles 10 are then fed into a bottle feed discharge chute 228 for processing.

In an embodiment of the present invention, the end of the bottle feed discharge chute 228 is coincident with the gripper assembly 120 bottle pickup location 102. The gripper assembly 120 picks up the waiting bottle 10 to be processed. As the bottle 10 is removed, the next bottle 10 is moved into place.

The second discharge chute 190 is positioned adjacent an inspection tray conveyor assembly 240. The inspection tray conveyor assembly 240 is adapted to convey the bottle's contents 11 past an inspection area 242. The conveyance may be driven by various means, such as by a belt or by vibratory conveyance. As the contents 11 are conveyed past the inspection area 242, the contents 11 may be inspected for quality. For example, contents 11 comprising damaged or broken tablets or capsules (debris) can be removed during the inspection process by directing the debris through a debris bin 244. The inspection tray conveyor assembly 240 further comprises an air handling system 246 to contain airborne dust particles. After the inspection process, the inspected contents 11, such as tablets or capsules are conveyed to the bulk container assembly 260 that comprises a slide 264 and bulk container 262. The tablets or capsules are subsequently discharged down the slide 264 into the a bulk container 262.

In one embodiment of the invention, a control assembly 280 is used to control the operations of the various components of the bottle opener assembly 100. In one embodiment, an attendant can regulate the speed of the operation using a foot controller. The control assembly 280 changes the speed of the bottle unpack/repack system 200 based on the input of the operator.

Figure 11:
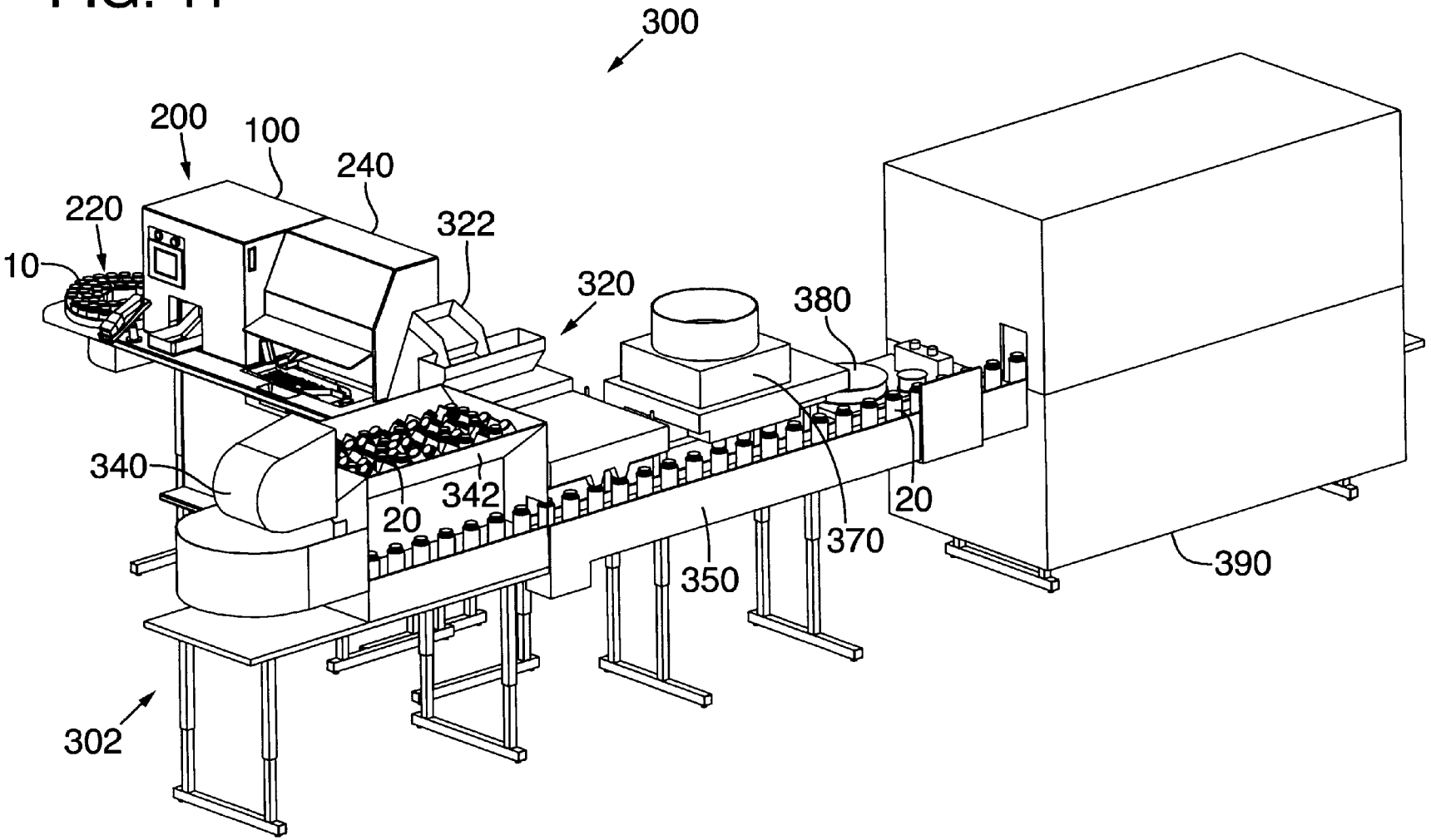
FIG. 11 is a perspective view of an embodiment of a bottle unpack/repack line in accordance with the invention.

FIG. 11 is a perspective view of an embodiment of a bottle unpack/repack line 300 in accordance with the invention, wherein the tablets or capsules are repackaged into new bottles 20. The bottle unpack/repack line 300 comprises the bottle unpack/repack system 200 in addition to a bottle handling apparatus 302. The bottle handling apparatus 302 comprises a bottle unscrambler 340, a bottle conveyor 350, a bottle capper 370 and a cartoner 390. Empty, uncapped new bottles 20 are loaded into a hopper 342 of the bottle unscrambler 340. The bottle unscrambler 340 correctly orients the new bottles 20 for conveyance to a tablet counter/bottle filling apparatus 320. The tablet counter/bottle filling apparatus 320 couples to the slide 264 of the inspection tray conveyor assembly 240, as shown in FIG. 10A. The tablet counter/bottle filling apparatus 320 elevates the contents 11, comprising tables/capsules using a tablet/capsule elevator assembly 322 and subsequently counts the tablets/capsules and deposits them into the new bottles 20. The new bottles 20 are conveyed to the bottle a capper 370 that places a bottle cap on the new bottle 20. The new bottles 20 are conveyed to a labeler 380 and subsequently to a cartoner 390.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the construction arts will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A method for removing tablet and/or capsule medication from bottles, comprising:

securing the bottle while leaving a bottom portion of the bottom accessible;

holding the bottle in a horizontal orientation;

using a blade to cut circumferentially around the bottom portion of the bottle to at least partially sever the bottom portion of the bottle; and removing the medication from the at least partially severed bottom portion of the bottle.

2. The method of claim 1, wherein securing the bottle while leaving the bottom portion of the bottom accessible comprises using a gripping apparatus adapted to couple with the bottle, the gripping apparatus comprising at least two elongated members adapted to clamp against a side of the bottle while leaving the bottom portion unobstructed; and wherein using a blade to cut circumferentially around the bottom portion of the bottle comprises using a slicing apparatus comprising a blade in cooperation with a mechanism for urging relative positioning of the slicing apparatus and gripping apparatus to at least partially sever the base portion of the bottle and provide access to the medication.

3. The method of claim 2, wherein using a slicing apparatus comprising a blade in cooperation with a mechanism for urging relative positioning of the slicing apparatus and gripping apparatus comprises spinning the bottle while holding the bottle against the blade.

4. A method for the dispensing of contents from a bottle, the bottle having a sidewall, a base adjacent the sidewall, and an axis perpendicular to the base, the method comprising:

holding the bottle such that the axis is in a horizontal orientation;

urging the sidewall against a blade adjacent the base;

piercing the sidewall;

rotating the bottle about the axis slicing the sidewall about but not completely around the circumference of the base defining a tab coupling the base to the sidewall; and pivoting the base from the sidewall about the tab dispensing the contents.

5. The method of claim 4, wherein piercing and slicing through the sidewall comprises using a bottle slicer assembly; and positioning and rotating the bottle about the axis comprises using a gripper assembly.

6. The method of claim 5, wherein using a bottle slicer assembly includes using a blade coupled to the bottle slicer assembly to pierce and slice through the sidewall.

7. The method of claim 6, wherein using a bottle slicer assembly includes using a blade guard in cooperative arrangement with the blade to abut the sidewall and prevent blade penetration beyond a predetermined depth.

8. The method of claim 7, wherein using a bottle slicer assembly includes using a bottle slicer assembly further comprises a nesting frame assembly having a first portion and a second portion in sliding biased apart nesting engagement, the first portion coupled with the blade.

9. The method of claim 5, further comprises using the gripper assembly to vertically translate the bottle and rotate the bottle to position the axis at or between a vertical and horizontal orientation, and engaging the sidewall with the slicer assembly while the axis is in a horizontal orientation.

10. The method of claim 9, further comprising using a translate/rotate assembly comprising a carriage assembly and vertical rods, wherein the gripper assembly is rotatably coupled to the carriage assembly, the carriage assembly adapted to vertically translate along the length of the vertical rods, the translate/rotate assembly adapted to rotate the gripping apparatus and bottle wherein the axis is positioned at or between a vertical and horizontal orientation.

11. The method of claim 5, further comprising holding the bottle with the gripper assembly having at least two spaced-apart elongated members in clamped engagement with the bottle there between, distal from the base.

12. The method of claim 5, further comprising collecting the contents by providing a discharge chute traverse assembly having a first discharge chute coupled to a discharge chute carnage assembly, translating the first discharge chute from a position below the slicer assembly to collect the contents discharged from the bottle, and translating the first discharge chute away from a position below the slicer assembly to avoid the bottle released by the gripper assembly.

13. The method of claim 12, further comprising collecting the empty bottles by providing a bottle discharge chute below the slicer assembly adapted to collect the bottle released by the gripper assembly, and translating the first discharge chute between the slicer assembly and the bottle discharge chute to collect the contents.

14. The method of claim 13, further comprising:

providing a bottle pickup location adjacent the bottle gripper assembly; and providing a bottle guide hingably coupled to the bottle discharge chute adjacent the bottle pickup location, the bottle guide movable from a first position in a first direction away from the bottle pickup location with a restoring bias back to the first position, the bottle guide comprising one or more slots adapted to receive the elongated members of the gripper assembly.

15. The method of claim 13, further comprising collecting the contents from the first discharge chute into the bulk container using a bulk container assembly adapted to receive the contents from the first discharge chute and convey the contents container for collection.

16. The method of claim 13, further comprising providing an inspection tray conveyor adapted to enable the inspection and sorting of the contents.

17. The method of claim 13, further comprising providing a bottle handling apparatus adapted to provide a bottle to receive at least a portion of the contents from the first discharge chute.

18. The method of claim 5, further comprising:

providing a bottle pickup location adjacent the bottle gripper assembly; and positioning a bottle at the bottle pickup location using a bottle feed assembly comprising a bottle hopper for receiving one or more bottles to be opened and a bottle conveyer for conveying a bottle to the bottle pickup location, the bottle gripper assembly adapted to collect the bottle for opening.

19. An apparatus for enabling the removal of capsule and/or tablet medication contained within a plastic bottle comprising:

a slicing apparatus adapted to at least partially sever a base portion from the bottle;

a gripping apparatus adapted to couple with the bottle, and a mechanism urging relative positioning of the slicing apparatus and gripping apparatus to at least partially sever the base portion of the bottle and provide access to the medication.

20. The apparatus of claim 19, wherein the slicing apparatus comprises a blade, the gripping apparatus rotating the bottle about the blade while the bottle is in urging engagement with the blade.

21. The apparatus of claim 19, wherein the gripping apparatus comprises at least two elongated members adapted to clamp against a side of the bottle while leaving a lower portion of the bottle adjacent the base portion unobstructed.

22. The apparatus of claim 21, further comprising a gripping apparatus positioning assembly, wherein the gripping apparatus positioning assembly is coupled to the gripping apparatus and adapted to move the gripping apparatus in a vertical direction and capable of rotating the gripping apparatus and coupled bottle to a horizontal orientation.

23. The apparatus of claim 22, wherein the slicing apparatus is adapted to partially sever the base portion from the bottle while the bottle is held in a horizontal orientation.

24. The apparatus of claim 23, further comprising a medication discharge chute, wherein the medication discharge chute is adapted to collect the medication as the medication is removed from the bottle through the at least partially severed base portion.

25. The apparatus of claim 24, further comprising a bottle discharge chute positioned below the bottle adapted to receive the bottle released from the gripper.

26. The apparatus of claim 25, further comprising a medication discharge chute positioning assembly, wherein the medication discharge chute positioning assembly is coupled to the medication discharge chute and adapted to translate the medication discharge chute in a horizontal direction from a first position under the bottle and above the bottle discharge chute to a second position away from under the bottle and above the bottle discharge chute, such that after the medication is dispensed into the medication discharge chute, the medication discharge chute positioning assembly translates the medication discharge chute horizontally to the second position exposing the bottle discharge chute below for receiving the bottle released from the gripping assembly.

27. An apparatus adapted to unpack tablet and/or capsule medication from a bottle and repackage the medication into a container, comprising:

a bottle feed assembly;

a bottle opener assembly comprising:

a gripping apparatus adapted to couple with the bottle, the bottle positioned relative to the gripping apparatus by the bottle feed assembly;

a slicing apparatus having a blade; and a mechanism urging relative positioning of the slicing apparatus and gripping apparatus to at least partially sever a base portion of the bottle to discharge the medication; and an inspection tray conveyor assembly comprising an inspection area and a medication discharge chute, the inspection tray conveyor assembly adapted to accept the discharged medication and convey the medication past the inspection area to the medication discharge chute to deposit the medication into the container.

28. The apparatus of claim 27, wherein the gripping apparatus is adapted to rotate the bottle about the blade of the slicing apparatus while the bottle is in urging engagement with the blade.

29. The apparatus of claim 28, wherein the bottle feed assembly comprises:

a hopper having spiral-shaped walls, the walls positioned to form a narrowed portion having a width of a single bottle, the hopper adapted to contain a plurality of bottles in a vertical orientation; and a turntable positioned below the spiral-shaped walls upon which the bottles are placed, the turntable adapted to position the bottles into the narrowed portion, the gripping apparatus adapted to couple with the bottle positioned in the narrowed portion.

30. An apparatus for enabling the removal of contents from a bottle, the bottle having a sidewall, a base adjacent the sidewall, and an axis perpendicular to the base, the apparatus comprising:

a bottle slicer assembly for slicing through the sidewall; and a gripper assembly for positioning and rotating the bottle about the axis with the sidewall in urging engagement with the bottle slicer assembly.

31. The apparatus of claim 30, wherein the bottle slicer assembly comprises a blade having an edge sufficient to pierce and slice through the sidewall upon urging engagement there with.

32. The apparatus of claim 31, wherein the bottle slicer assembly further comprises a blade guard in cooperative arrangement with the blade to engage the sidewall preventing further blade penetration into the bottle.

33. The apparatus of claim 32, wherein the slicer assembly further comprises a nesting frame assembly having a first portion and a second portion in sliding biased apart nesting engagement, the first portion coupled with the blade.

34. The apparatus of claim 30, further comprising a translate/rotate assembly comprising a carriage assembly and vertical rods in sliding engagement, the gripper assembly rotatably coupled to the carriage assembly.

35. The apparatus of claim 30, wherein the gripper assembly comprises at least two spaced-apart elongated members for clamping engagement with the bottle distal from the base.

36. The apparatus of claim 30, further comprising a discharge chute traverse assembly having a first discharge chute coupled to a discharge chute carriage assembly, the first discharge chute movable from a position below the slicer assembly to a position away from below the slicer assembly.

37. The apparatus of claim 36, further comprising a bottle discharge chute positioned below the slicer assembly with the first discharge chute there between.

38. The apparatus of claim 37, further comprising:

a bottle pickup location adjacent the bottle gripper assembly; and a bottle guide hingably coupled to the bottle discharge chute adjacent the bottle pickup location, the bottle guide movable from a first position in a first direction away from the bottle pickup location with a restoring bias back to the first position, the bottle guide comprising one or more slots adapted to receive the elongated members of the gripper assembly.

39. The apparatus of claim 36, further comprising:

a bulk container assembly; and a bulk container, the bulk container assembly positioned to receive the contents from the first discharge chute and convey the contents to the bulk container for collection.

40. The apparatus of claim 36, further comprising an inspection tray conveyor positioned to receive the contents.

41. The apparatus of claim 36, further comprising a bottle handling apparatus adapted to provide a bottle to receive at least a portion of the contents from the first discharge chute.

42. The apparatus of claim 30, further comprising:

a bottle pickup location adjacent the bottle gripper assembly;

a bottle feed assembly comprising having a bottle hopper for receiving one or more bottles and a bottle conveyer for conveying a bottle to the bottle pickup location.

* * * * *